US008286823B2

(12) United States Patent
Turvey et al.

(10) Patent No.: US 8,286,823 B2
(45) Date of Patent: Oct. 16, 2012

(54) CONTAINER WITH ANTI-BUCKLING STRUCTURAL FEATURES

(75) Inventors: Robert R. Turvey, Sanford, MI (US); Joseph Anhalt, Brainerd, MN (US)

(73) Assignee: S.C. Johnson & Son, Inc., Racine, WI (US)

( * ) Notice: Subject to any disclaimer, the term of this patent is extended or adjusted under 35 U.S.C. 154(b) by 65 days.

(21) Appl. No.: 12/805,740

(22) Filed: Aug. 18, 2010

(65) Prior Publication Data

US 2012/0000924 A1 Jan. 5, 2012

Related U.S. Application Data

(63) Continuation-in-part of application No. 12/828,162, filed on Jun. 30, 2010.

(51) Int. Cl.
*B65D 6/02* (2006.01)
*B65D 8/04* (2006.01)
*B65D 90/02* (2006.01)

(52) U.S. Cl. ..... 220/675; 220/660; 220/669

(58) Field of Classification Search ..... 220/608, 220/668, 669, 660, 675; 206/508
See application file for complete search history.

(56) References Cited

U.S. PATENT DOCUMENTS 3,033,414 A 5/1962 Galland
5,301,827 A 4/1994 Valyi
5,423,453 A * 6/1995 Fritz ..... 220/608
D378,039 S 2/1997 Ferris
D418,020 S 12/1999 Tardif
6,102,209 A 8/2000 D'Andrea
6,398,062 B1 * 6/2002 Jones ..... 220/608
D465,887 S 11/2002 Begnani
6,733,852 B2 5/2004 Littlejohn et al.
D514,389 S 2/2006 Luna et al.
7,063,231 B2 6/2006 Stanos et al.
7,258,905 B2 8/2007 Whitmore et al.
7,261,219 B2 * 8/2007 Tucker et al. ..... 220/793
D551,503 S 9/2007 Bouie
D560,977 S 2/2008 Lown et al.
D571,609 S 6/2008 Bouie
7,398,892 B2 7/2008 Bouie
7,398,893 B2 7/2008 Bouie
D576,034 S 9/2008 Rosario Pereira da Costa
7,419,067 B2 9/2008 Bouie et al.
2002/0175171 A1 11/2002 Stewart et al.
2003/0034351 A1 2/2003 Van Handel et al.
2005/0029259 A1 2/2005 Famham
2005/0145638 A1 7/2005 Van Handel
2006/0261065 A1 11/2006 Claypool et al.
2008/0099484 A1 5/2008 Bouie
2009/0223969 A1 9/2009 Bouie

* cited by examiner

*Primary Examiner* — Harry Grosso

(57) ABSTRACT

The invention is directed to a thermoformed, rectangular disposable storage container. The container includes a base and lid. The base includes arched front and rear walls to redistribute the pressure placed on the top of the container and to generally evenly balance the load force around the container front, rear and end walls to prevent buckling of the container front or rear walls. The container lid includes an arched front wall and rear wall which generally corresponds to the degree of arch of the front and rear walls of the base.

12 Claims, 2 Drawing Sheets

A
X 10
14
40
7
44
30
6
32
26
12
20
28
24
50

26
20
28
12
50

32

44
42
32

CONTAINER WITH ANTI-BUCKLING STRUCTURAL FEATURES

RELATED APPLICATION

This is a continuation-in-part of U.S. patent application Ser. No. 12/828,162, filed Jun. 30, 2010, which application disclosure is incorporated herein by reference.

FIELD OF INVENTION

The present invention relates to disposable storage containers. More particularly, the invention is directed to thermoformed, rectangular thermoplastic storage containers for food and the like having anti-buckling structural features, including a base having arched or convex front and rear walls and a corresponding lid therefor.

BACKGROUND OF THE INVENTION

Storage containers include an open top base for storage and a lid to close the base. The lid and base mate to define the closure and seal. Thermoformed, rectangular storage containers are known in the art.

In considering container design, price and value, and sometimes price alone, often drive the container design; the materials used; and the ultimate construction and performance of storage containers. There are often tradeoffs in the quality of the container design and the intended use of the container. Additionally, the increased cost of resin has made container design important to optimize the use of resin while concurrently providing a quality container, e.g. providing a lightweight container using less resin.

Many types of storage containers are available in the marketplace, including for food storage and the like. These containers generally fall under several categories, including (1) single use or disposable containers made of plastic or paper; (2) semi-durable containers which are disposable after a few uses; and (3) durable containers manufactured for multiple uses.

The present invention is directed to thermoformed, rectangular disposable thermoplastic storage containers. The amount of plastic used adds to the weight and to the cost of the container. As previously stated, rectangular thermoformed storage containers are known in the art. These containers are made by known thermoforming techniques such as vacuum thermoforming, pressure thermoforming or mechanical thermoforming, although the most prevalent thermoforming of rectangular storage containers is vacuum thermoforming with a plug assist. A problem experienced in making rectangular thermoplastic containers as opposed to, for example, square or cylindrical containers, is that rectangular containers have different strength issues in the longer front and rear walls of the container. For example, with a container as shown in FIG. 1, the longer front wall A (as well as the rear wall not shown) has a propensity to buckle in the area "X" because of the larger area of unsupported material, i.e. this portion is usually thinner due to the thermoforming process and is farthest from the support corner structures. Through physical testing and Finite Element Analysis, it has been determined that area "X" as shown in FIG. 1 is where buckling is likely to occur when a load is applied to the container. Such buckling may cause container failure and consequently customer dissatisfaction with the container. One current method to avoid buckling is the use of more plastic which increases the strength of the container front and rear walls. However, this also increases the weight of the container and the cost of the container.

Accordingly, there is a need in the market for a thermoformed, rectangular disposable thermoplastic storage container which is lightweight, attractive, easy and inexpensive to manufacture, and in which the front and rear walls are not subject to buckling.

SUMMARY OF INVENTION

The present invention is directed to thermoformed, rectangular disposable thermoplastic storage containers having a lid and a base. The rectangular container base includes front and rear walls of similar structure, end walls of similar structure, a bottom wall and an open top for receiving and removing the material to be stored. The upper portions of the front and rear walls of the base are arched or convex in shape. This arch or convex structure differs from the prior art containers in that the arch or convex configuration redistributes the pressure placed on the top of the container front and rear walls to the shorter and stronger end walls. This shifting of the load more evenly balances the load force around the container and increases the overall buckling force of the entire container. The degree of arching or convex configuration of the front and rear walls will vary with the overall dimensions of the container. Accordingly, the degree of arching or convex configuration is satisfied when generally equal buckling load is on all four walls of the base.

The container base further may include a generally inverted U-shaped rim for mating with the container lid for providing a seal and closure to the container when the lid is placed on the base. Various known sealing and closure geometries may be used in providing the seal and closure.

The container lid also includes an arched or convex configuration which corresponds to that of the front and rear walls of the base. The arch in the lid also provides additional strength to the container when under load. The container lid further includes a generally inverted U-shaped lip which mates with the base rim for sealing and closing the container. Various configurations of the lip may be used with the invention as known in the art. The lid further may include a recessed portion which allows for stacking of multiple containers.

The term "rectangular" as used herein to describe the container includes a container having front and rear walls which are longer than the end walls. It is also understood that the corners of the container may be of different configurations, e.g. rounded, straight or variations thereof.

The different embodiments of the invention will be apparent from the following description of the preferred embodiments of the invention and from the accompanying drawings.

BRIEF DESCRIPTION OF THE DRAWINGS

The following detailed description of specific non-limiting embodiments of the present invention can be best understood when read in conjunction with the following drawings, where like structures are indicated with like reference numbers.

DETAILED DESCRIPTION OF THE PERFERRED EMBODIMENTS

Figures 1, 2, 3, 6, 7:
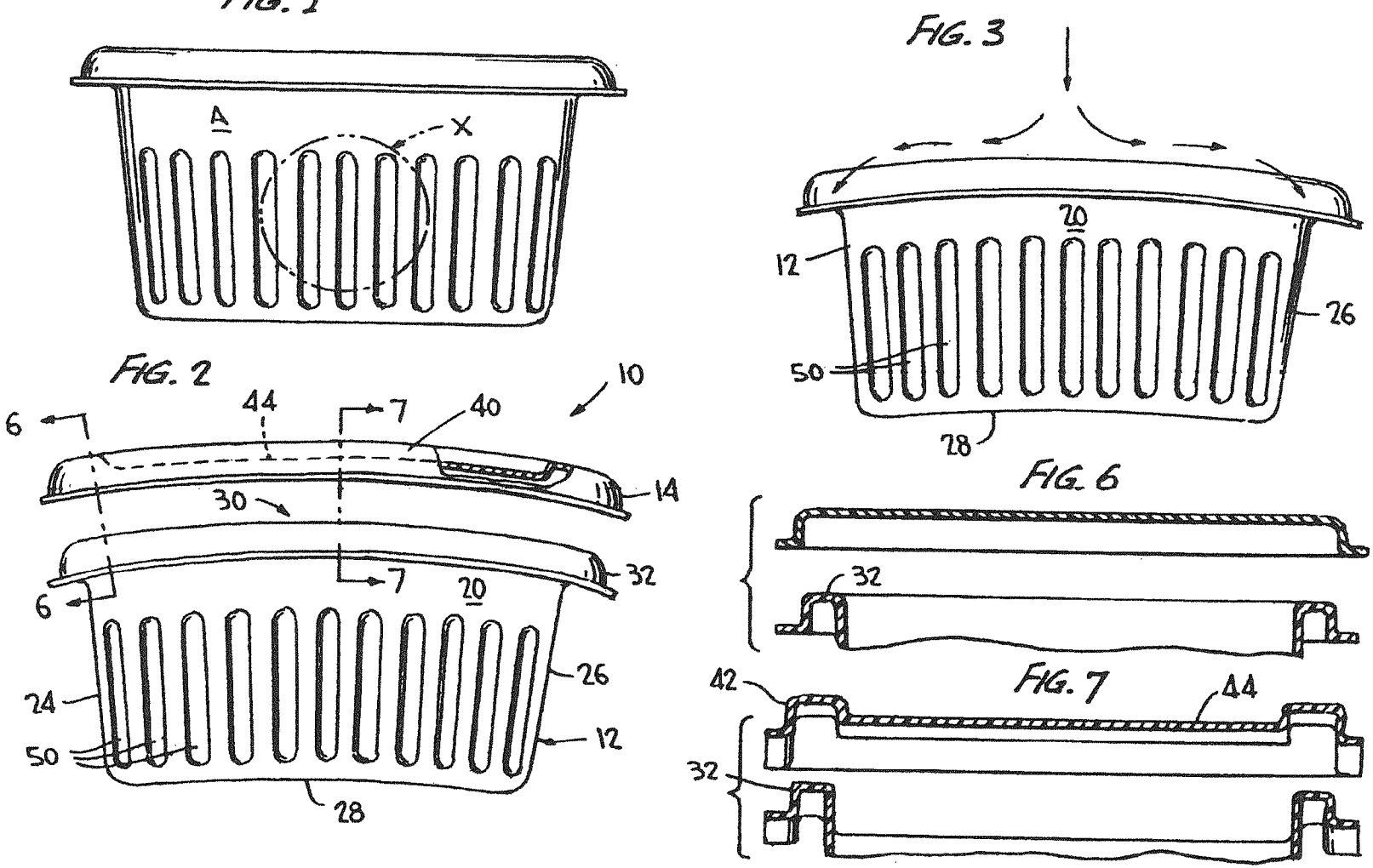
FIG. 1 is a front view of a rectangular storage container.
FIG. 2 is a front exploded view of the lid and base of the rectangular storage container of the present invention.
FIG. 3 is a front view of the base of the container of FIG. 2 illustrating the diversion of the top load to the end walls to balance the load over the container walls.
FIG. 6 is a partial cross-sectional view of the lid and base along line 6-6 of FIG. 2.
FIG. 7 is a partial cross-sectional view of the lid and base along line 7-7 of FIG. 2.
Figure 4:
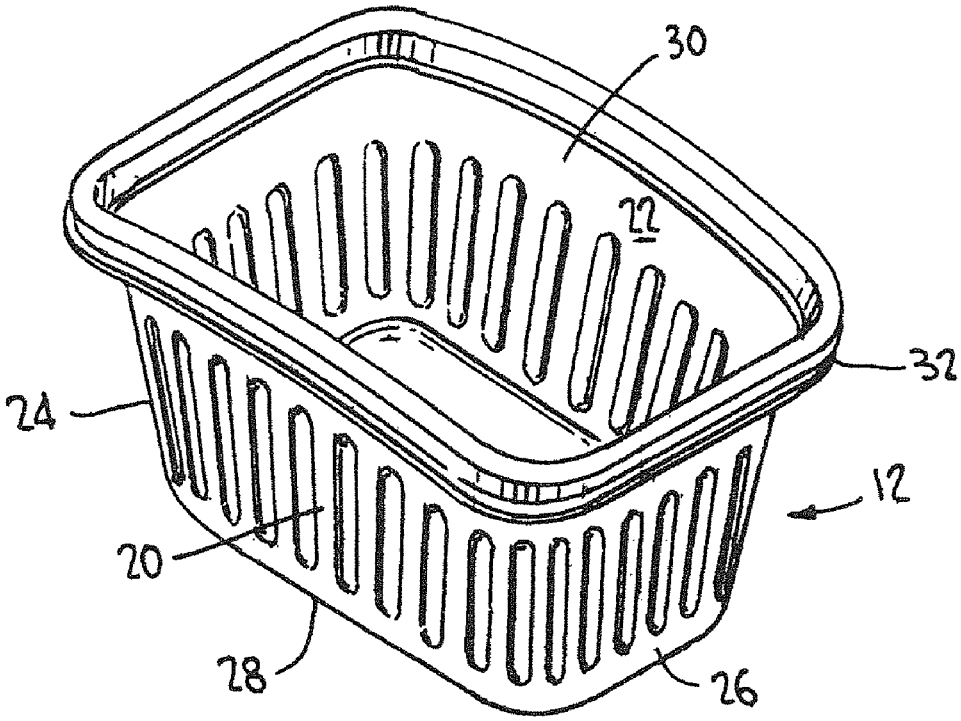
FIG. 4 is a top perspective view of the base of the container of FIG. 2.

Referring to the drawings, the container 10 of the invention comprises a base 12 and lid 14. The container is a thermoformed, rectangular disposable thermoplastic container for the storage of food or other material. A primary novel feature of the invention is providing a container having front and rear walls which will not buckle under load and which have generally similar load bearing strength as the end walls, thereby allowing for the use of less resin and providing for a lighter weight and less expensive container. These novel attributes are achieved by having front and rear walls which are arched or convex in shape and which thereby redistribute the pressure placed on the top of the container to the shorter and stronger end walls. The degree of the arch may vary depending on the overall dimensions of the container. The degree of the arch required will be sufficient provided that it redistributes the pressure from the front and rear walls to the end walls such that the pressure is generally evenly balanced to prevent buckling of the front and/or rear walls.

The container base 12 includes front wall 20, rear wall 22 and end walls 24 and 26. Front and rear walls 20 and 22 are generally of the same construction and dimensions. Similarly, end walls 24 and 26 are generally of the same construction and dimension. Base 12 further includes a bottom wall 28 and top opening 30 for receiving and removing the items stored in the container.

The front, rear and end walls may be tapered inwardly from the top of the base toward the bottom wall such that the bottom wall circumference is less than that of the top opening 30. This will allow for stacking of multiple containers 10 as discussed hereafter.

Figure 5:
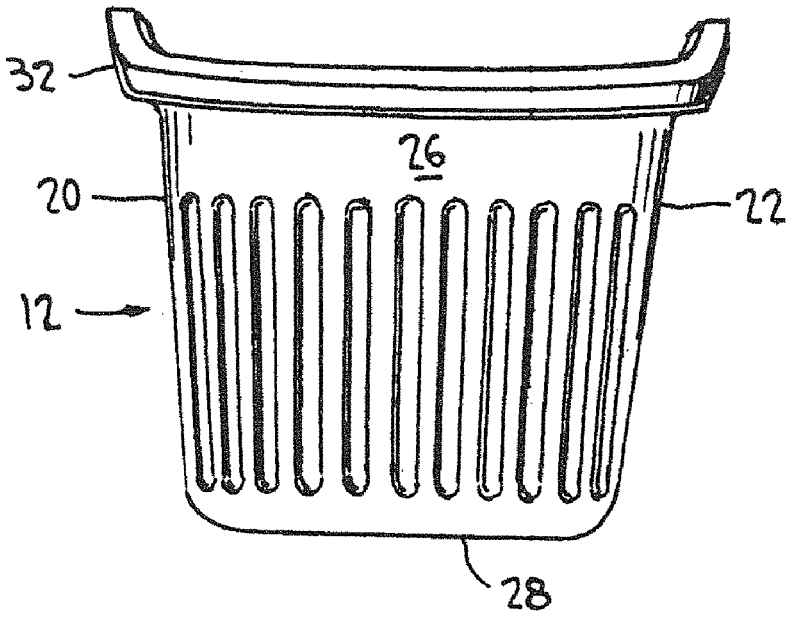
FIG. 5 is an end view of the base of the container of FIG. 2.

Front and rear walls 20 and 22 are arched or convex in shape as best seen, for example, in FIGS. 2, 3 and 5. This structure provides for redistribution of the pressure placed on the top of the container to the shorter and stronger end walls 24 and 26 which are not arched and are in the same plane as seen, for example, in FIG. 5. The degree of arch may vary depending on various factors, including the container dimensions and aesthetics. The degree of arch will be sufficient provided that it is such that it redistributes the pressure and thereby shifts the load from the longer front and rear walls 20 and 22 to the shorter and stronger end walls 24 and 26 as shown by the arrows in FIG. 3.

The base further includes a generally inverted U-shaped rim 32 for receiving lid 14 to seal and close container 10. Other geometries for rim 32 are known in the art such as disclosed, for example, in U.S. Pat. No. 7,063,231 assigned to S. C. Johnson Home Storage, Inc. and incorporated herein by reference.

Lid 14 is constructed to mate with base 12 to seal and close the container. Lid 14 includes front and rear arched walls 40 corresponding to the degree of arch as front and rear walls 20 and 22 of base 12. The arch in the lid provides additional strength to the container when under load. Lid 14 includes a generally inverted U-shaped lip 42 which mates with rim 32 to seal and close the container. Referring to FIGS. 2 and 7, the lid preferably also includes a recessed portion 44. The recessed portion provides for an ornamentally aesthetically pleasing container and also allows for the stacking of multiple containers 10. The bottom wall 28 of base 12 will fit in recess portion 44 due to the inwardly tapering of walls 20, 22, 24 and 26 of the base.

The container lid and base are made of a disposable thermoplastic. A preferred plastic is polypropylene. However, other plastics such as polyethylene, polystyrene, polyvinyl chloride (PVC) and acrylonitrile-butadiene styrene (ABS) may be used without departing from the scope of the invention. Preferably, the container lid and base are made of the same plastic, although they may be made of different plastics, e.g. the container base may be made of polypropylene and the container lid may be made of polyethylene or vice versa. The container lid and base are made by known thermoforming molding processes, a preferred process being vacuum thermoforming. Additionally, the containers may be transparent, translucent or opaque and may be colored or colorless.

The storage container of the present invention may further include supporting ribs 50 to provide additional strength to the container as disclosed, for example, in application Ser. No. 12/828,162, filed Jun. 30, 2010, and assigned to the assignee of this application, and which disclosure is incorporated herein by reference.

The preferred embodiments of the invention include containers providing a volume up to about 4 cups and generally wherein the width of the container is about one-half the length of the container or greater than one-half of the length of the container. For example, containers using the invention may have dimensions including, but not limited to, 0.8 Cup that is approximately 4" L×2.8" W×2.5" T and a 2.75 Cup that is approximately 5" L×4.5" W×3.2" T. The preferred range being between 0.8 Cup and 2.75 Cup.

To evaluate the anti-buckling performance of the containers 10, Finite Element Analysis (FEA) may be used to model and calculate the container's maximum load, maximum wall displacement under the maximum load, and buckling load. The FEA of the exemplary containers may be performed using, among other programs, ANSYS® software, namely ANSYS Multiphysics. In performing the analysis, the exemplary container is divided into four quarter sections through two imaginary perpendicular vertical planes, the buckling load of the container may be calculated through the following steps: (1) for each quarter section of the container, calculating the stress $S_{10N}$(MPa) developed in the container when an arbitrary load of 10 N is applied to the top quarter rim of the container; (2) assuming a linear relationship between the load and stress, calculating the maximum load of the quarter section under maximum stress $S_{max}$, i.e. the yield strength of the container material (for polypropylene $S_{max}$=33 MPa); (3) multiply the maximum load of the quarter section by four to obtain the maximum load of the container $L_{max}$(lbs) . Once the maximum load is determined, buckling load $L_{buckling}$ (lbs) may be calculated by multiplying the maximum load $L_{max}$ (lbs) by a buckling factor obtained through the FEA modeling.

The exemplary embodiments herein disclosed are not intended to be exhaustive or to unnecessarily limit the, scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

We claim:

1. A plastic storage container comprising:

a thermoformed plastic rectangular base having a front wall, a rear wall, end walls, a bottom wall, and an open top for receiving and removing a material to be stored in the container, each of said front wall and said rear wall oppose each other and said end walls oppose each other, with each of said front wall, said rear wall and said end walls including an upper rim at the open top of the base wherein the upper rim of each of the front wall and the rear wall has an arched configuration which together are sufficient to balance the load force substantially evenly over the front wall, the rear wall and the end walls to prevent buckling of the front wall and the upper rim of each of the end walls is not arched and are in a common plane; and the rear wall, and a plastic rectangular lid having front and rear portions and end portions constructed and arranged for mating respectively with the first wall, the rear wall and the end walls of the base to provide a closure for said open top of said base, wherein a mating surface of the front and rear portions which provides said closure has an arched configuration same as the arched configuration of the front wall and the rear wall, and a mating surface of the end portions which provides said closure is in said common plane of the end walls; wherein said storage container is constructed to be a disposable container.

2. The storage container of claim 1 wherein said upper rim is an inverted U-shaped rim and said lid includes an inverted U-shaped lip wherein said rim and said lip are constructed and arranged to mate to provide said closure for said open top of said base.

3. The storage container of claim 1 wherein said front wall, said rear wall and said end walls taper inwardly from said open top toward said bottom wall and said lid includes a recessed portion wherein said bottom wall of said base and said recessed portion of said lid are constructed and arranged to allow stacking of one or more of said containers.

4. The storage container of claim 1 wherein said plastic material of said lid and said base is selected from the group consisting of polyethylene, polypropylene, polystyrene, polyvinyl chloride and acrylonitrile-butadiene styrene.

5. The storage container of claim 1 wherein the thermoformed base is made using thermoforming processes selected from the group consisting of vacuum thermoforming, pressure thermoforming and mechanical thermoforming.

6. The storage container of claim 1 wherein the front wall, the rear wall and the end walls of said base include ribs for providing additional load bearing strength to said walls.

7. A plastic storage container comprising:

a thermoformed plastic rectangular base having (1) a front wall and a rear wall opposing each other and of equal length, (2) end walls opposing each other and of equal length, (3) a bottom wall, and (4) an open top for receiving and removing a material to be stored in the container, wherein the length of said front wall and said rear wall is greater than said length of said end walls, wherein each of said front wall said and said end walls have an upper rim at the open top of the base, wherein each said upper rim of said front wall and said rear wall has an arched configuration and an inverted U-shape, and each said upper rim of the end walls is not arched and are in a common plane; and a plastic rectangular lid having front and rear portions having a surface with an arched configuration same as the arched configuration of the front wall and the rear wall, and end portions with a surface constructed and arranged for mating with the upper rim of the end walls, wherein said front and rear portions and said end portions provide a closure for said open top of said base; wherein said storage container is constructed to be a disposable container.

8. The storage container of claim 7 wherein said front and rear portions and said end portions are configured as an inverted U-shaped lip so that said upper rim and said lip mate to provide the closure for said open top of said base.

9. The storage container of claim 7 wherein said front wall, said rear wall and said end walls taper inwardly from said open top toward said bottom wall and said lid includes a recessed portion wherein said bottom wall of said base and said recessed portion of said lid are constructed and arranged to allow stacking of one or more of said containers.

10. The storage container of claim 7 wherein said plastic material of said lid and said base is selected from the group consisting of polyethylene, polypropylene, polystyrene, polyvinyl chloride and acrylonitrile-butadiene styrene.

11. The storage container of claim 7 wherein the thermoformed base is made using thermoforming processes selected from the group consisting of vacuum thermoforming, pressure thermoforming and mechanical thermoforming.

12. The storage container of claim 7 wherein the front wall, the rear wall and the end walls of said base include ribs for providing additional load bearing strength to said walls.

* * * * *